US007667150B2

(12) United States Patent
Robbins et al.

(10) Patent No.: US 7,667,150 B2
(45) Date of Patent: Feb. 23, 2010

(54) MOVEABLE ARM FOR A CIRCUIT BREAKER AND METHOD FOR MAKING THE SAME

(75) Inventors: W. Dale Robbins, Snellville, GA (US); Karsten Freundt, Falkensee (DE); Eduardo Vidal, Nuevo Leon (MX)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 12/395,727

(22) Filed: Mar. 2, 2009

(65) Prior Publication Data

US 2009/0223793 A1 Sep. 10, 2009

Related U.S. Application Data

(60) Provisional application No. 61/033,479, filed on Mar. 4, 2008.

(51) Int. Cl.
*H01H 1/22* (2006.01)

(52) U.S. Cl. ..... 200/244

(58) Field of Classification Search ..... 200/244; 218/22–27, 146; 335/195, 166, 6, 202, 16, 335/46, 147, 193; 29/622
See application file for complete search history.

(56) References Cited

U.S. PATENT DOCUMENTS

| | | | | | |
|---|---|---|---|---|---|
| 2,616,011 | A * | 10/1952 | Elliott | ..... | 200/244 |
| 2,658,129 | A * | 11/1953 | Nichols et al. | ..... | 200/237 |
| 4,339,642 | A * | 7/1982 | Seymour et al. | ..... | 200/558 |
| 4,864,261 | A * | 9/1989 | Kandatsu | ..... | 335/16 |
| 5,146,194 | A * | 9/1992 | Altenhof et al. | ..... | 335/16 |
| 5,510,761 | A * | 4/1996 | Boder et al. | ..... | 335/172 |
| 6,563,407 | B2 * | 5/2003 | Kramer | ..... | 335/16 |
| 6,878,890 | B1 * | 4/2005 | Stay et al. | ..... | 200/244 |
| 7,217,895 | B1 * | 5/2007 | Shea et al. | ..... | 200/244 |

* cited by examiner

*Primary Examiner*—Michael A Friedhofer
(74) *Attorney, Agent, or Firm*—Jose de la Rosa

(57) ABSTRACT

A movable arm assembly for a circuit breaker includes a unitary structure having two blade portions being connected by a bend location. The bend location forms a gapless surface region. A contact is connected to the unitary structure wherein the gapless surface region and a contact surface of the contact are connected to form a joint therebetween. A method for forming a movable arm assembly includes forming a blank from a conductive sheet, the blank including a unitary structure having two blade portions, bending the blade portion at a bend location to form a gapless surface region at the bend location and joining a contact to the unitary structure on the gapless surface region at the bend location to form a movable arm assembly.

20 Claims, 8 Drawing Sheets

MOVEABLE ARM FOR A CIRCUIT BREAKER AND METHOD FOR MAKING THE SAME

RELATED APPLICATION INFORMATION

This application claims priority to Provisional Application Ser. No. 61/033,479 filed on Mar. 4, 2008, incorporated herein by reference.

BACKGROUND

1. Technical Field

This disclosure relates to circuit breakers, and more particularly, to a device and method for improving performance of a main contact in a short circuit condition.

2. Description of the Related Art

A circuit breaker is an important part of an electrical power system. The breaker ensures maximum current limiting without increasing damage to the breaker itself. Loss of union between contacts and blades of a breaker is a common problem when an arc occurs. This can occur due to heat and/or high current through the breaker. Heat and high current may result in damage to the breaker.

In one instance, heat is caused due to the bad placement of a weldment between the blade and the contact. This problem may be caused by the lack of filler metal at the surface where the contact is welded. When brazing or soldering, flux can be eliminated by using a phosphorus bearing filler metal, e.g., Sil-Fos® or solder. This filler metal typically flows during the joining process.

Referring to FIG. 1, two blades 12 and 14 are separately fabricated. The blades 12 and 14 are joined by a weld 22 formed using a welding process 20, e.g., an ultrasonic welding process. After welding, features such as a protrusion 16 and a corresponding locating hole 18 are aligned. Protrusion 16 and locating hole 18 provide a feature that is used to attach an operating spring.

Referring to FIG. 2, the two blades 12 and 14 are simultaneously joined to a contact 22 by soldering or brazing. The blades 12 and 14 include a gap 26 between them. Solder or filler metals 24 wick into the gap 26 and rob the joint between contact 22 and blades 12 and 14 of the filler metal. This prevents a good union between the blades 12 and 14 and the surface contact 22. Since the joint between the contact 22 and the blades 12 and 14 is very active during the operation of a circuit breaker, a poor joint here results in poor performance of the circuit breaker. Resistive heat can be generated and even arcing may occur in particularly bad joints.

SUMMARY OF THE INVENTION

A movable arm assembly for a circuit breaker includes a unitary structure having two blade portions being connected by a bend location. The bend location forms a gapless surface region. A contact is connected to the unitary structure wherein the gapless surface region and a contact surface of the contact are connected to form a joint therebetween.

In one embodiment, a circuit breaker includes a movable contact, and a movable arm assembly including a unitary structure having two blade portions being connected by a bend location. The bend location forms a gapless surface region at the bend location. The movable contact is connected to the unitary structure wherein the gapless surface region and a contact surface of the contact are connected to form a joint therebetween. A fixed contact is configured to connect with the movable contact during an operating condition and be separated in an off or tripped condition. A handle is configured to set or reset the movable arm assembly in accordance with one of the operating condition and the off or tripped condition.

A method for forming a movable arm assembly includes forming a blank from a conductive sheet. The blank includes a unitary structure having two blade portions. The blade portion is bent at a bend location to form a gapless surface region at the bend location. A contact is joined with the unitary structure on the gapless surface region at the bend location to form a movable arm assembly.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

In accordance with the present principles, displacement of a filler metal from a joint between a blade and a contact is significantly improved. In one embodiment, a method is provided to form a main blade from a single piece of material to eliminate any gap between blades. This maximizes the amount of filler metal in the surface of a joint between a main blade and a contact. The blade advantageously provides a flat surface without any gap to interface with a flat surface of the contact. In a particularly useful embodiment, a method is provided where two blades are formed in a single process from a single piece of material to eliminate the blade-to-blade gap. A metal sheet is stamped (or other processing is performed) and bent to provide a flat surface for mounting the contact.

The present principles are not limited to the illustrative example for a circuit breaker contact mounting and may be employed with other brazed or soldered joints where a filler metal or material is employed. While the joint between the contact and the blades preferably includes filler metals employed in solder joints or brazed joints, the joint may also include a weld or even a conductive epoxy or glue, and, in general, any liquid or liquefied connection material that could possible escape the joint region by wicking or flowing.

All statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those skilled in the art that the block diagrams presented herein represent conceptual views of illustrative system components.

Figure 1:
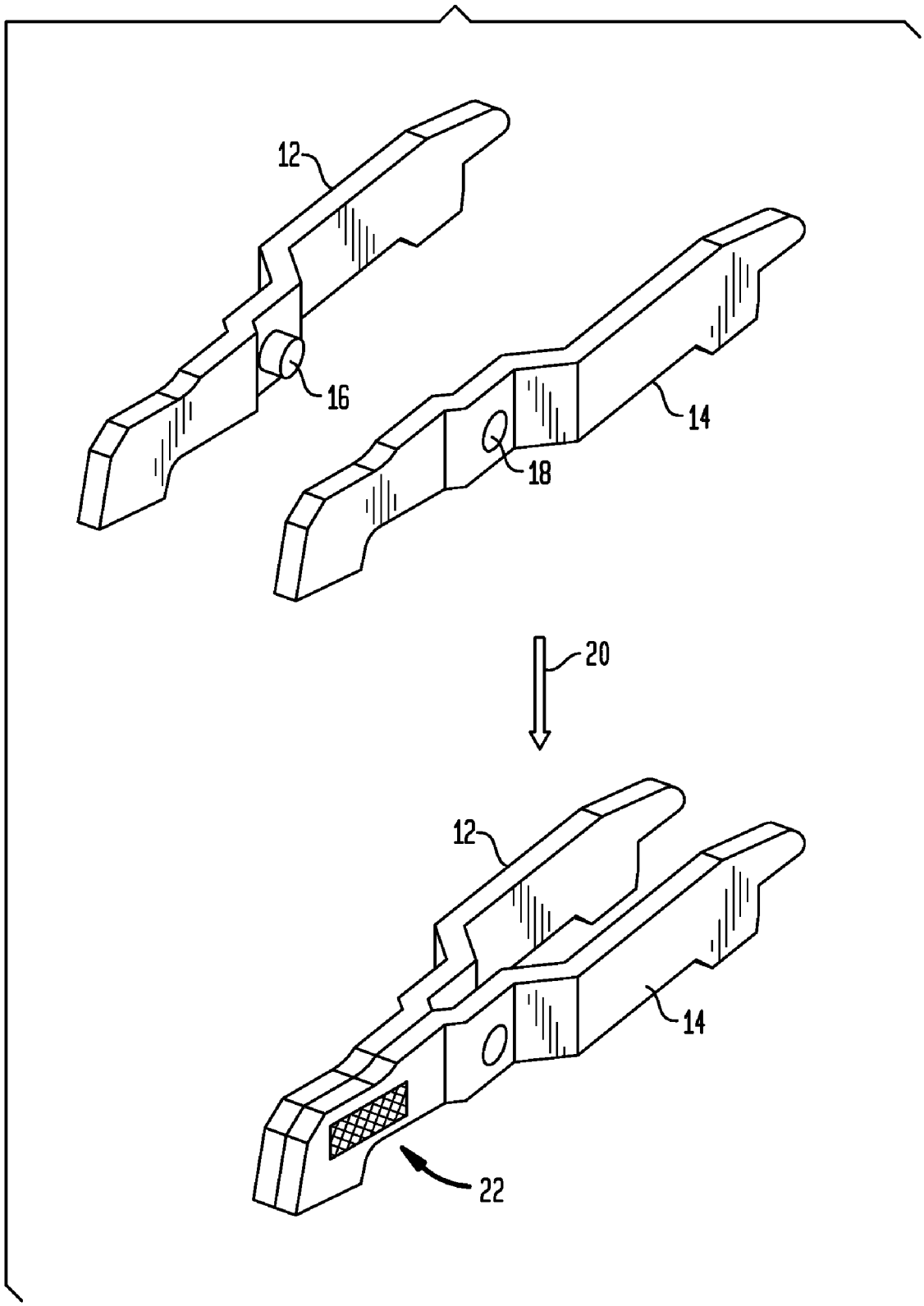
FIG. 1 (PRIOR ART)
FIG. 1 is a perspective view showing two blades joined by a welding process in accordance with the prior art.
Figure 2:
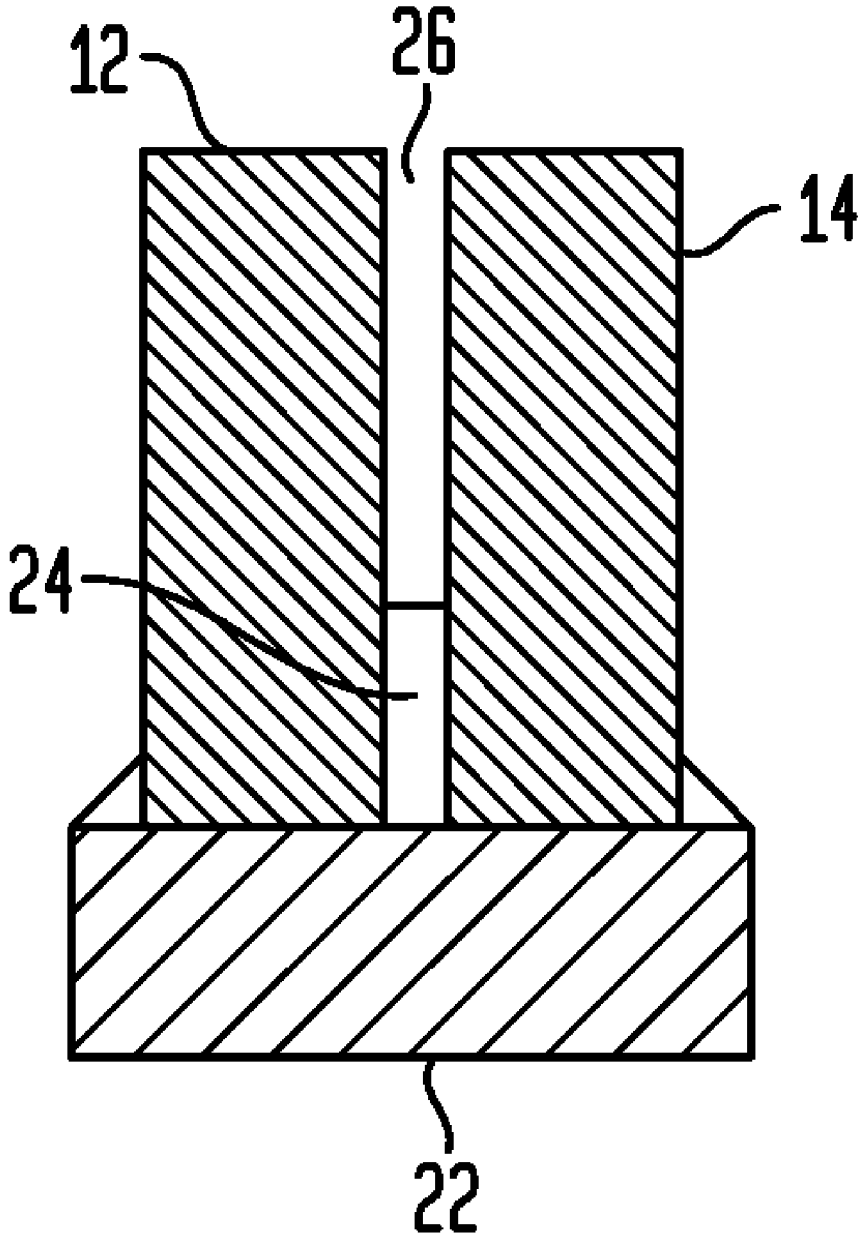
FIG. 2 (PRIOR ART)
FIG. 2 is a cross-sectional view of the blades in FIG. 1 soldered to a contact where solder wicks away from the joint.
Figure 3:
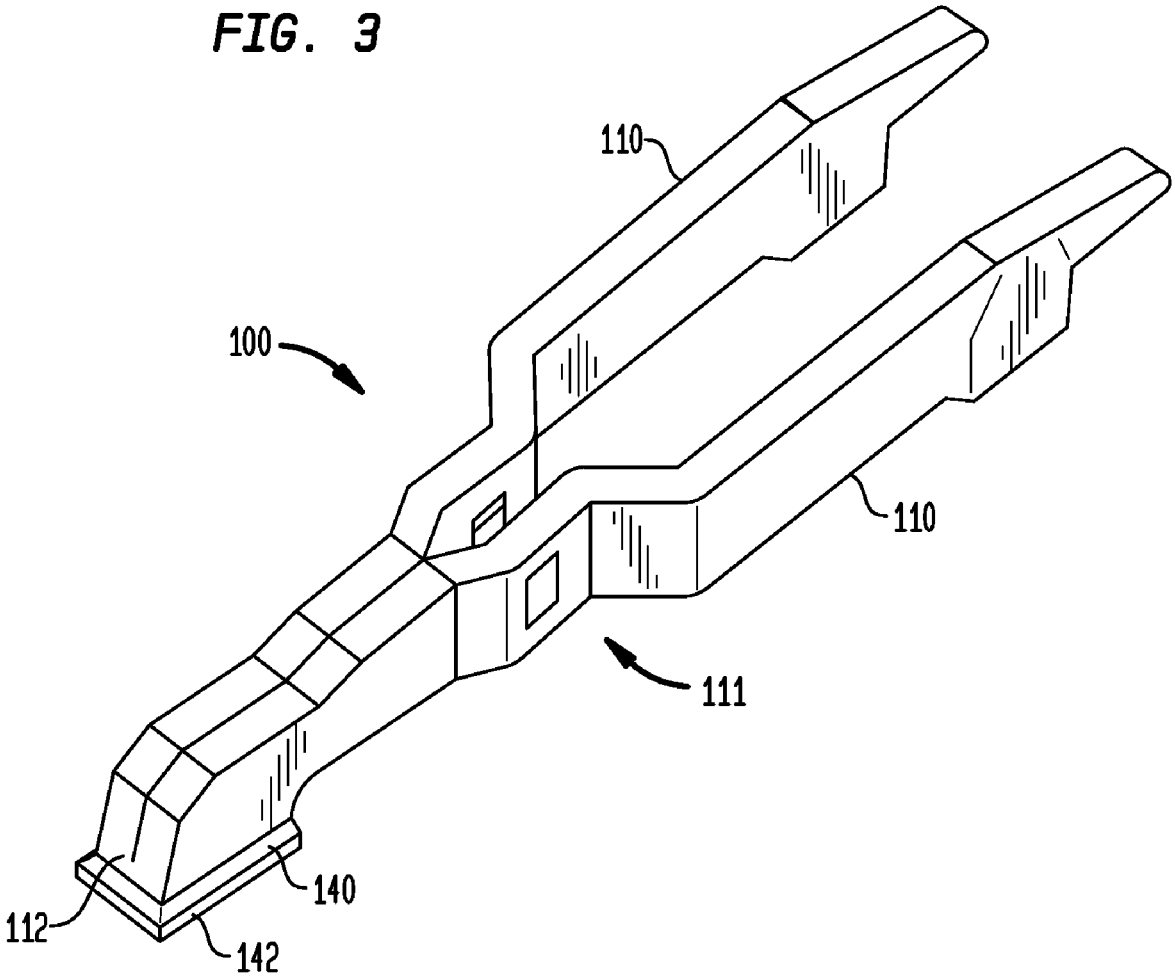
FIG. 3 is a perspective view of a movable arm assembly in accordance with one illustrative embodiment.

Referring now in specific detail to the drawings in which like reference numerals identify similar or identical elements throughout the several views, and initially to FIG. 3, a movable arm assembly 100 is illustratively shown in accordance with one embodiment. Assembly 100 includes a unitary wishbone structure 111 formed from a single piece of conductive material. The assembly 100 may be made from sheet metal and may include steel, aluminum, copper or any other suitable conductive material (metal alloys of these and other metals, etc.).

The wishbone structure 111 includes blade portions or wings 110. Blade portions 110 are connected at a bend portion 112. Bend portion 112 is connected by a joint 140 to a contact 142. The joint 140 may include a solder or brazed joint, although other connecting methods may be employed, e.g., conductive epoxies, etc.

In a particularly useful embodiment, assembly 100 forms a main blade or movable arm for a circuit breaker. The single piece of metal of assembly 100 is cut to fit contours of the main blade. The forming processes for the single piece of metal may include punching, cutting from a sheet, stamping or any other process that fits the form specified by the assembly 100.

Figure 4A:
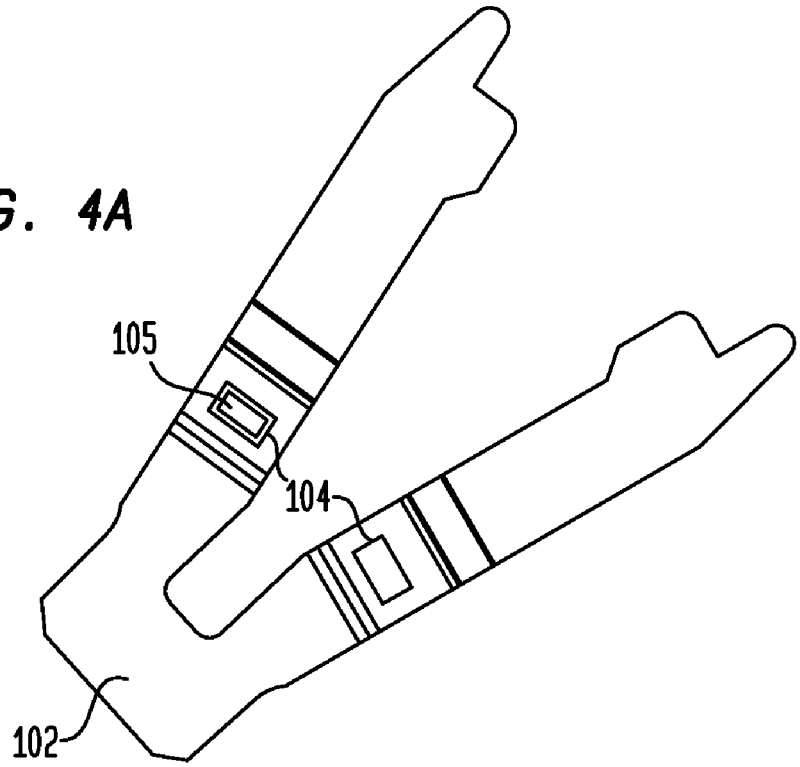
FIGS. 4A-4D show a process for forming and bending a blank to create a unitary wishbone structure in accordance with the present principles.

Referring to FIGS. 4A-4D, illustrative process steps for forming the main blade of assembly 100 are shown. In FIG. 4A, a single piece of conductor is formed as a blank 102 for assembly 100. The blank 102 is cut from a sheet by any number of processes, e.g., punching, cutting, stamping, etc. Geometric features 104 such as holes, tabs, etc. can be punched during this step as well. A tab foldout 105 may be formed which is employed to hold an operating spring (not shown) in a final circuit breaker assembly. The tab foldout 105 may be punched or stamped through the material of block 102 to create a protrusion to capture or anchor the spring. This spring is employed to bias the main blade to enable a tripping force (or a recovery force, depending on the design).

Figure 4B:
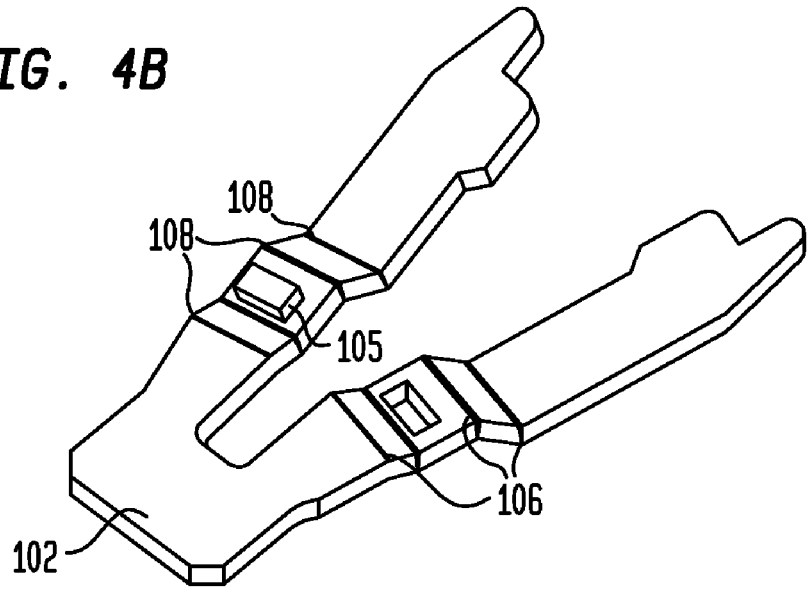

In FIG. 4B, any bending needed in the plane of the blank 102 is made. For example, bends 106 and 108 are made. These bends 106 and 108 may be made by punching, bending, etc. A break or similar tool may be employed to provide bends 106 and 108 to fit all the angles that are needed to get the part in a correct shape.

Figure 4C:
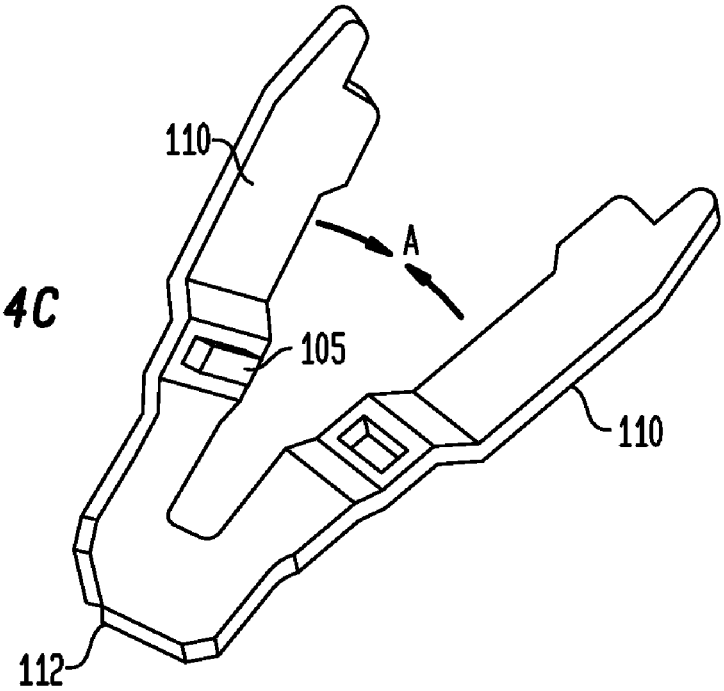
Figure 4D:
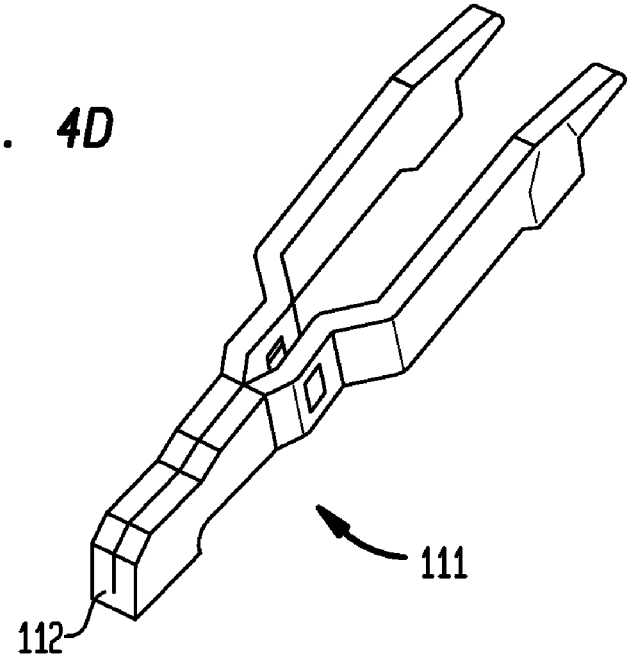

In FIG. 4C, another bending process is employed to bend wings or blade portions 110 in the direction of arrow "A". This bending process bends the blade portions 110 at a bend location 112 and brings both sides together in a functional form as depicted in FIG. 4D. At the bend location 112, a flat end forms without the use of welding. Further, the bend location 112 forms a position for joining a contact by brazing, soldering, etc. without the existence of any gaps between the folded halves of structure 111.

Figure 5:
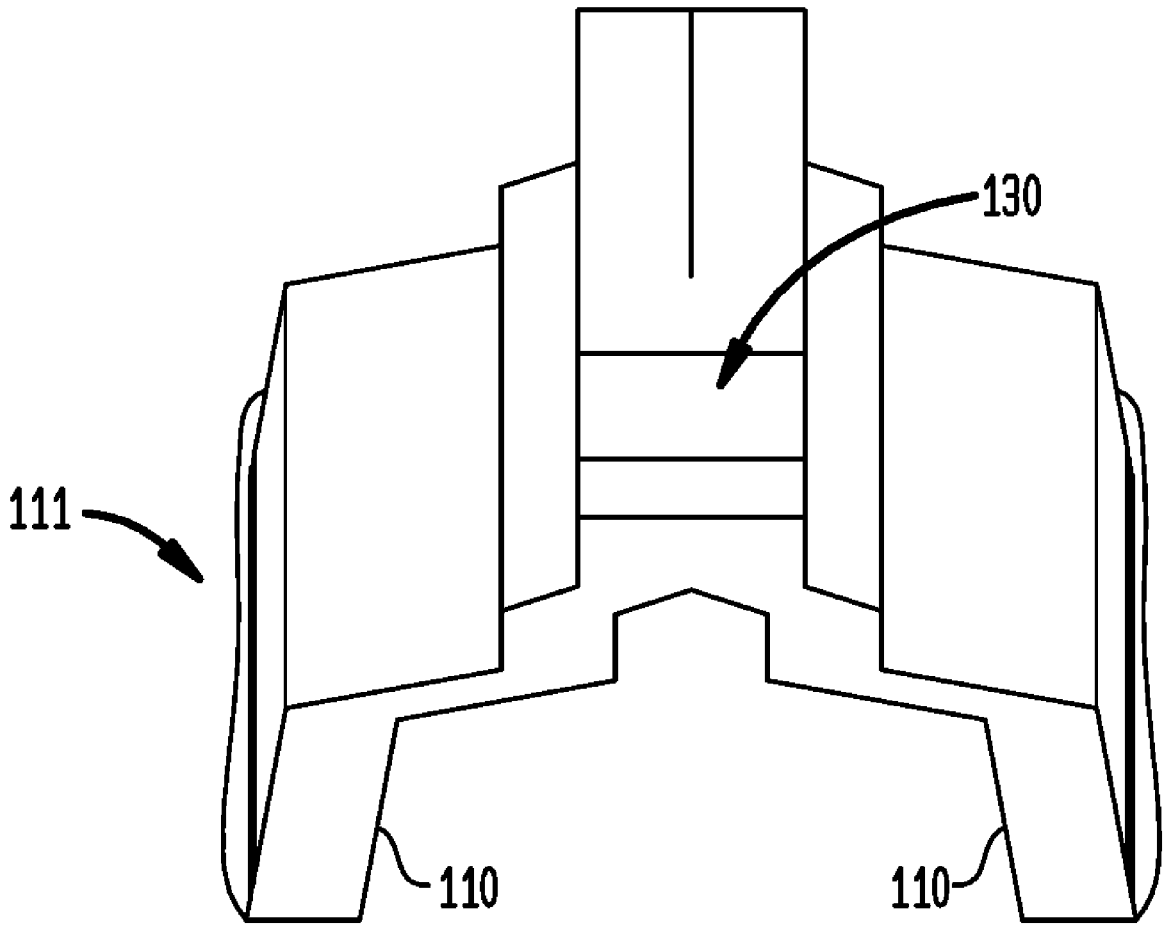
FIG. 5 is a perspective view of the unitary wishbone structure showing a bend location surface employed for connecting to a contact in accordance with the present principles.

Referring to FIG. 5, a perspective view shows an underside of the structure 111. A solid flat surface or gapless surface region 130 is provided. Surface 130 is employed to connect a contact (not shown) thereto. In useful embodiments, the surface 130 may be cleaned by degreasing or by ultrasonic cleaning to ensure the removal of foreign matter, such as oils or the like. This ensures a good surface to solder to for attaching a contact. Advantageously, since there is no gap at surface 130 there is no wicking of cleaning materials that would affect the soldering/brazing process for attaching the contact. The surface 130 may also treated, roughened or otherwise prepared to ensure the best results in joining the surface 130 with a contact.

Figure 6:
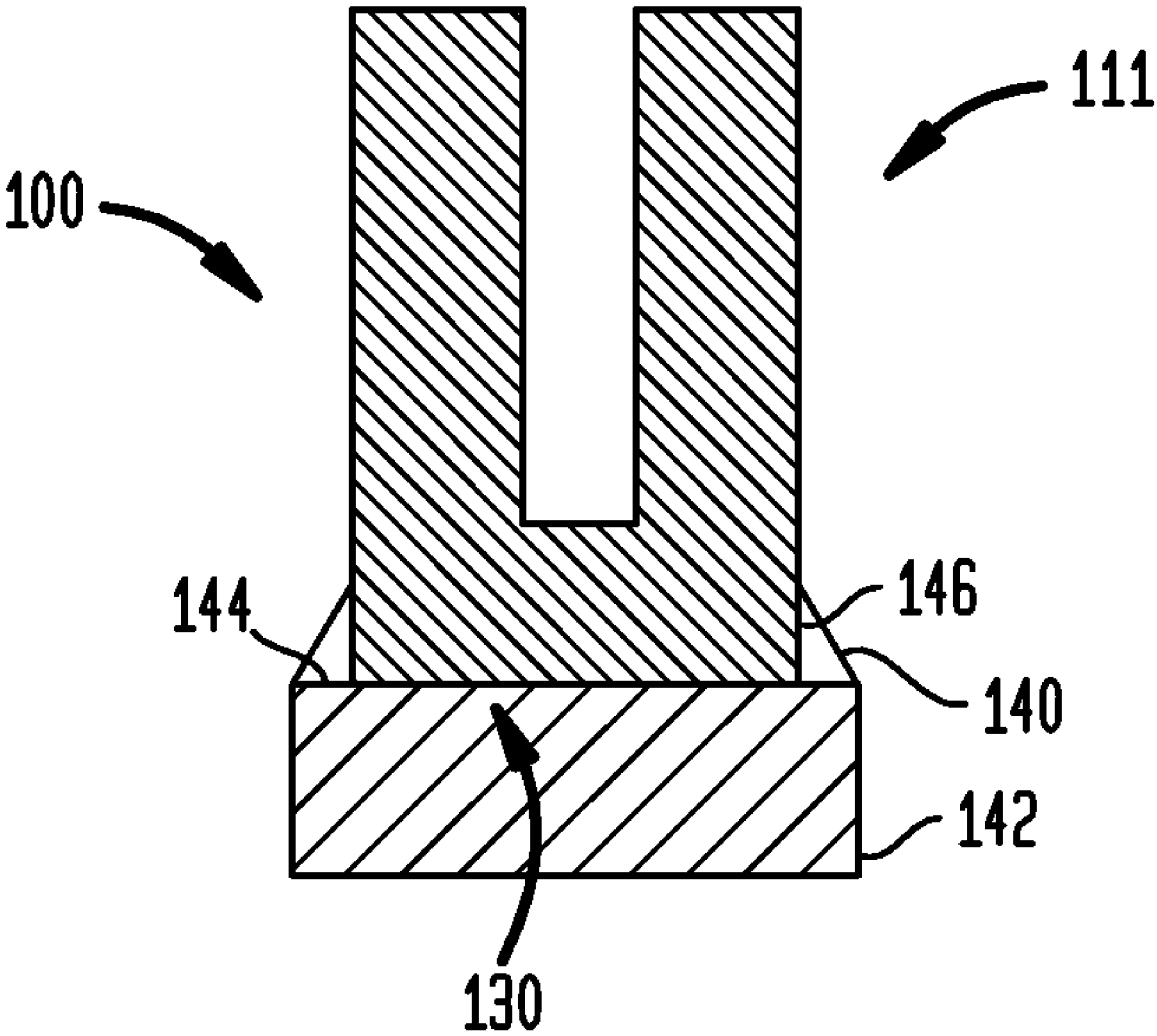
FIG. 6 is a cross-sectional view of a joint between a structure without gaps and a contact in accordance with the present principles.

Referring to FIG. 6, a front view of assembly 100 shows a solder joint 140 connecting surface 130 with a contact 142. Contact 142 includes a prepared surface 144 which contacts surface 130. A solder material is distributed between surface 130 and 142 to form joint 140. Regions 146 provide an interface for solder and a solder bead/joint 140 is formed around the assembly 100. Regions are preferably flat to provide a largest possible solder area for joint 140. A solder fillet will form at the junction of the flat surface of region 146 and the contact 142. This ensures good solder coverage and is easy to inspect.

Figure 7:
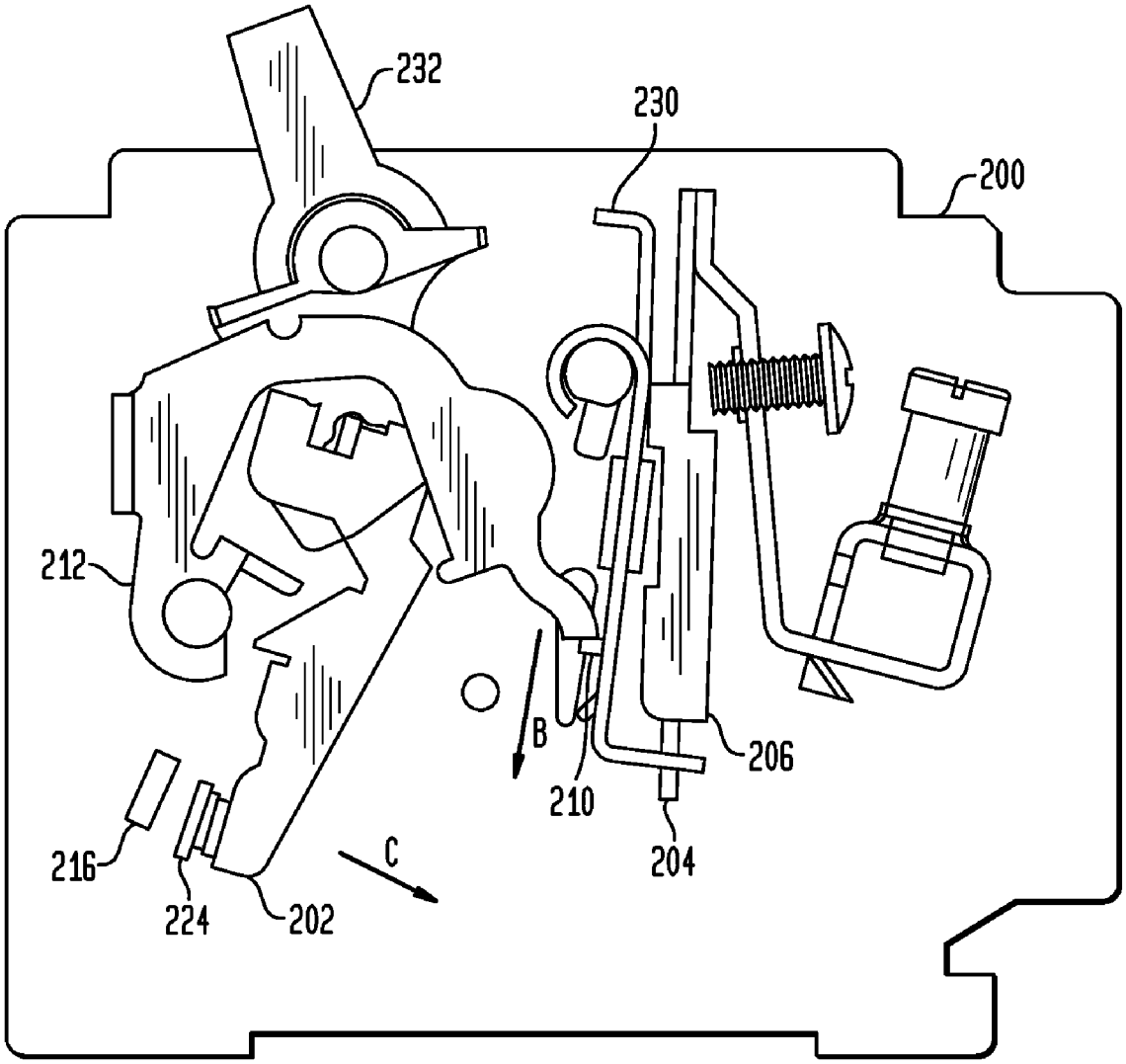
FIG. 7 is a side view illustratively showing a circuit breaker having a movable arm assembly in accordance with one illustrative embodiment.

Referring to FIG. 7, a diagram shows the interaction between a main arm assembly 202 (same as movable arm assembly 100) having an attached contact 224 (same as contact 140) and a fixed contact 216. A mechanical pole can be tripped with a bimetal 204 or a magnetic construction 206 to handle surges and/or overload conditions. A circuit breaker 200 is designed with the bimetal 204 and magnetic yoke assembly 206 to mechanically detect when an overload or instantaneous condition exists. When either of these conditions exists, armature 230 is rotated by the bending of the bimetal 204 or by the magnetic force generated by the yoke assembly 206. As the armature 230 rotates, the mechanism pole de-latches and trips the mechanism, thus opening a circuit. This permits a notch 210 on armature 230 to move away from a cradle 212. The cradle 212 rotates passed notch 210 (in the direction of arrow "B"). This, in turn, causes the main blade 202 to trip and move away from the stationary or fixed contact 216 in the direction of arrow "C" to cause an open circuit thereby breaking contact between contacts 216 and 224.

Contacts 216 and 224 are connected in an on position of a handle 232 and are separated in an off position of the handle 232. The handle 232 is coupled to contact 224 through the movable arm assembly 202 to adjust the contacts between the on position, the off position, and a trip position. The trip position results when an overload or surge occurs. It should be understood that other circuit breaker designs may be employed in accordance with the present principles.

In addition to the advantages set forth above, the present principles provide a better fabricated movable arm assembly. This is achieved since the solder joint formed between the contact and the main blade are better controlled, are flat against each other when soldering (without gaps where filler material can escape), and provide a more stable solder joint configuration. As a result, the movable arm assembly is more accurately positioned within a circuit breaker, makes better contact between a fixed contact and a movable contact and generates less heat as a result of better electrical contact and better mechanical integrity of the joint. Further, the present principles provide for lower cost since at the very least an additional welding process is eliminated and two parts (blades) are replaced by one. This also results in reduced labor and overhead costs.

Having described preferred embodiments for an improved movable arm for a circuit breaker and method for making the same (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A moveable arm assembly for a circuit breaker, comprising:

a unitary structure having two blade portions being connected by a bend location, the bend location forming a gapless surface region; and a contact connected to the unitary structure on the gapless surface region wherein the gapless surface region and a contact surface of the contact are connected to form a joint therebetween.

2. The arm assembly as recited in claim 1, wherein the joint includes one of a solder joint and a brazed joint.

3. The arm assembly as recited in claim 1, wherein the unitary structure includes formed sheet metal.

4. The arm assembly as recited in claim 1, wherein the unitary structure includes at least one of steel, copper, aluminum and an alloy thereof.

5. The arm assembly as recited in claim 1, further comprising bend portions on the two blade portions.

6. The arm assembly as recited in claim 1, wherein the bend location includes a flat region substantially perpendicular to the gapless surface region to assist in forming a solder bead between the gapless surface region and the contact surface.

7. A circuit breaker, comprising:

a moveable contact;

a moveable arm assembly including a unitary structure having two blade portions being connected by a bend location, the bend location forming a gapless surface region at the bend location, the moveable contact being connected to the unitary structure on the gapless surface region wherein the gapless surface region and a contact surface of the contact are connected to form a joint therebetween;

a fixed contact configured to connect with the moveable contact during an operating condition and be separated in an off or tripped condition; and a handle configured to set or reset the moveable arm assembly in accordance with one of the operating condition and the off or tripped condition.

8. The breaker as recited in claim 7, wherein the joint includes one of a solder joint and a brazed joint.

9. The breaker as recited in claim 8, wherein the unitary structure includes formed sheet metal.

10. The breaker as recited in claim 8, wherein the unitary structure includes at least one of steel, copper, aluminum and an alloy thereof.

11. The breaker as recited in claim 8, further comprising bend portions on the two blade portions.

12. The breaker as recited in claim 8, wherein the bend location includes a flat region substantially perpendicular to the gapless surface region to assist in forming a solder bead between the gapless surface region and the contact surface.

13. A method for forming a moveable arm assembly for a circuit breaker, comprising:

forming a blank from a conductive sheet, the blank including a unitary structure having two blade portions;

bending the two blade portions at a bend location to form a gapless surface region at the bend location; and joining a contact to the unitary structure on the gapless surface region at the bend location to form a moveable arm assembly.

14. The method as recited in claim 13, wherein joining includes one of soldering and brazing.

15. The method as recited in claim 13, wherein forming a blank includes at least one of punching, stamping and cutting the unitary structure from sheet metal.

16. The method as recited in claim 13, wherein the unitary structure includes at least one of steel, copper, aluminum and an alloy thereof.

17. The method as recited in claim 13, further comprising bending portions on the two blade portions within a plane of the blank.

18. The method as recited in claim 13, further comprising roughening a surface of the bend location to assist in forming a solder joint with the contact.

19. The method as recited in claim 13, further comprising installing the moveable arm assembly in a circuit breaker.

20. The method as recited in claim 13, wherein bending the two blade portions at a bend location includes bending the blank transversely to a plane of the blank to form the bend location.

* * * * *